US012366428B2

(12) United States Patent
Evans

(10) Patent No.: US 12,366,428 B2
(45) Date of Patent: Jul. 22, 2025

(54) ADJUSTABLE TENSION DEVICE

(71) Applicant: Edge-Works Manufacturing Co., Burgaw, NC (US)

(72) Inventor: Scott V Evans, Jacksonville, NC (US)

( * ) Notice: Subject to any disclaimer, the term of this patent is extended or adjusted under 35 U.S.C. 154(b) by 300 days.

(21) Appl. No.: 18/046,104

(22) Filed: Oct. 12, 2022

(65) Prior Publication Data

US 2023/0125148 A1 Apr. 27, 2023

Related U.S. Application Data

(60) Provisional application No. 63/254,966, filed on Oct. 12, 2021.

(51) Int. Cl.
*F41C 33/04* (2006.01)

(52) U.S. Cl.
CPC ..... *F41C 33/041* (2013.01); *F41C 33/048* (2013.01)

(58) Field of Classification Search
CPC ..... F41C 33/04; F41C 33/048
See application file for complete search history.

(56) References Cited

U.S. PATENT DOCUMENTS

| | | | | |
|---|---|---|---|---|
| 4,969,768 | A * | 11/1990 | Young | F16M 13/022 403/97 |
| 10,408,566 | B2 * | 9/2019 | Pagac | F41C 33/0245 |
| 10,443,974 | B2 * | 10/2019 | Finsand | F41C 33/008 |
| 10,712,124 | B2 * | 7/2020 | Courtney | F41C 33/04 |
| 10,837,734 | B2 * | 11/2020 | Finsand | F41C 33/008 |
| 10,883,795 | B2 * | 1/2021 | Rogers | F41C 33/045 |
| D919,964 | S * | 5/2021 | Evans | D3/222 |
| 11,054,215 | B2 * | 7/2021 | Foster | F41C 33/043 |
| 11,686,553 | B2 * | 6/2023 | Foster | F41C 33/0263 224/243 |
| 12,018,912 | B2 * | 6/2024 | Cosico | F41C 33/06 |
| 2006/0135295 | A1 * | 6/2006 | Szelenyi | A63B 60/00 473/549 |

* cited by examiner

*Primary Examiner* — Justin M Larson
(74) *Attorney, Agent, or Firm* — Intellectual Property Consulting, LLC; Stephen M. Kepper; Bernard Meroney

(57) ABSTRACT

An adjustable tension device for use in connection with accessories designed to be worn inside of a user's waistband. The tension device is operable to attach to said accessory and provide an added point of leverage against the user's clothing, thereby holding the accessory snugly against the user's body. The tension device includes a base, and fixed arm, and a plurality of extensions of varying lengths, wherein said extensions are able to attach to the fixed arm, thereby providing varying arm lengths depending on the orientation of the accessory in relation to the user's body.

12 Claims, 3 Drawing Sheets

10

115, 130
209
110
207
207
140, 205
101
207
207
200
205
137

205
101
115, 130
110
10
250
260
270
200
10
210
137
101
205
205
135
130
110
10
115
101

207
200
205
137
115, 130, 101
112
110

200
10
205
137
101
205

115, 130
110

FIGURE 6
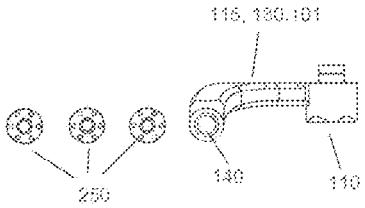
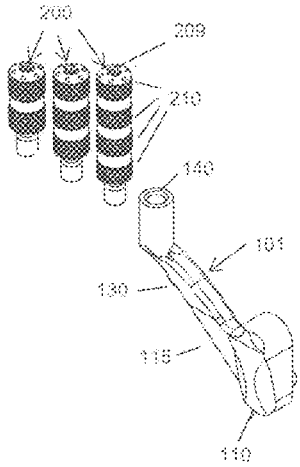
FIGURE 7
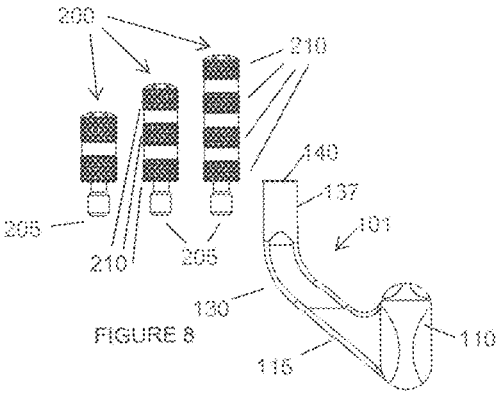
FIGURE 8
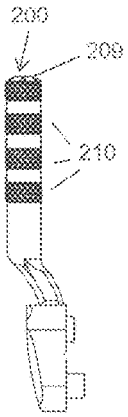
FIGURE 9
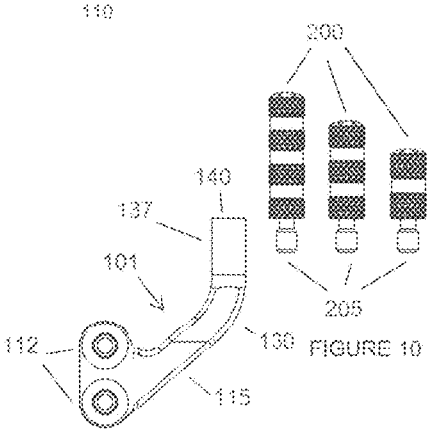
FIGURE 10

FIGURE 11
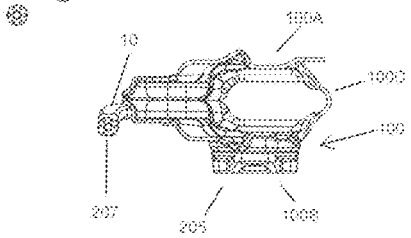
FIGURE 12
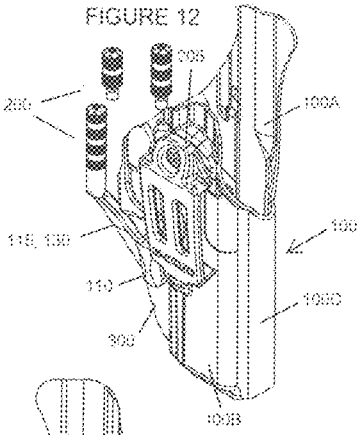
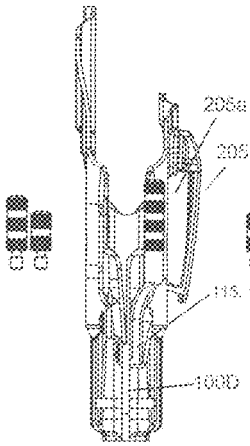
FIGURE 13
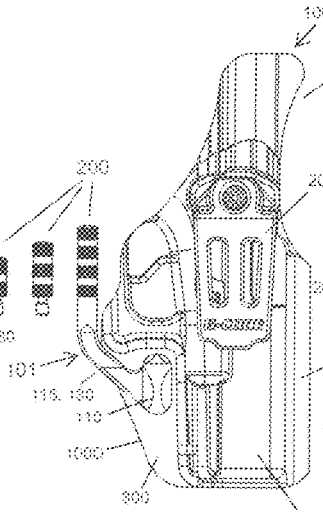
FIGURE 14
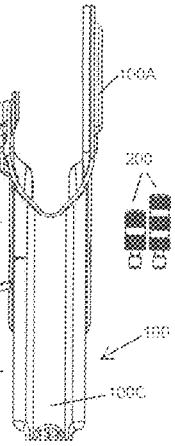
FIGURE 15
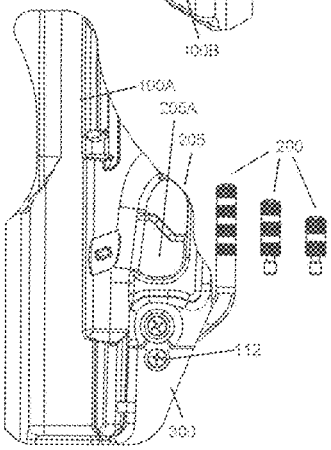
FIGURE 16

ADJUSTABLE TENSION DEVICE

I. CROSS-REFERENCE TO RELATED APPLICATIONS

This application claims the priority benefit of U.S. provisional patent application 63/254,966, filed on Oct. 12, 2021, and which is incorporated by reference in its entirety.

BACKGROUND OF THE INVENTION

II. Field of the Invention

The invention relates to an adjustable tension device for use in connection with concealed carry holsters and other accessories meant to be worn under an outer layer of clothing in a concealed fashion. Specifically, the invention provides a tension device that can be mounted on the accessory device where the user is able to adjust the dimensions of the tension device via the use of interchangeable extension arms.

III. General Background

Belt-worn accessories, such as holsters, are often worn inside of clothing in a concealed manner. It is often desirable to use a leverage or tension member in connection with concealed accessories to hold the accessory close to the body of the wearer by providing a point of leverage that pushes against the interior of the wearer's waistband and belt or clothing. Many concealed accessories are capable of adjustment relative to the wearer's body, which can move a non-adjustable tension device to a position where the tension device is no longer in contact with the wearer's waist and/or belt, thereby making the tension device less effective. Thus, there exists a need for an adjustable tension device that allows the user to easily customize the dimensions of the tension member in coordination with the wearer's preferred orientation for the concealed accessory in question. The dimensions that can be varied are the length or thickness of extension arm, where thickness is measured from contact area (the grip area) of the extension arm facing the user's belt or clothing adjacent the belt, through the extension arms side facing the user, such as the user's waistline. For the cylindrical extension arm, the thickness is the diameter of the cylinder.

SUMMARY OF THE INVENTION

In accordance with one embodiment, the present invention is an adjustable tension device comprising: a fixed arm, wherein said fixed arm comprises a base and a lower arm, and a second arm, wherein the lower arm comprises a first end and a second end, wherein the first end of the lower arm is attached to the base and said second end is attached to a second arm, and the end of the second arm distal from the lower arm comprises an attachment point; preferably the fixed arm components are integral with each other; and a plurality of extension arms, wherein each extension arm comprises a length and thickness, a first end, and one or more grip areas, and wherein, for each extension arm, the first end comprises an attachment point operable to fixedly attach to the attachment point of the fixed arm' second arm; wherein the length or thickness of at least one extension arm of the plurality of extension arms is different from the length or thickness of another extension arm of the plurality of extension arms.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein:

FIG. 6 depicts a top view of an adjustable tension device with exemplary interchangeable extension arms.

FIG. 7 depicts a front, perspective view of an adjustable tension device with exemplary interchangeable extension arms.

FIG. 8 depicts a front view of an adjustable tension device with exemplary interchangeable extension arms.

FIG. 9 depicts a side view of an adjustable tension device with exemplary interchangeable extension arms.

FIG. 10 depicts a rear view of an adjustable tension device with exemplary interchangeable extension arms.

FIG. 11 depicts a top view of an adjustable tension device with exemplary interchangeable extension arms, where one extension arm is installed, and where said adjustable tension device is attached to a holster designed to be worn inside an article of clothing.

FIG. 12 depicts a front, perspective view of an adjustable tension device with exemplary interchangeable extension arms, where one extension arm is installed, and where said adjustable tension device is attached to a holster designed to be worn inside an article of clothing.

FIG. 13 depicts a side view of an adjustable tension device with exemplary interchangeable extension arms, where one extension arm is installed, and where said adjustable tension device is attached to a holster designed to be worn inside an article of clothing.

FIG. 14 depicts a front view of an adjustable tension device with exemplary interchangeable extension arms, where one extension arm is installed, and where said adjustable tension device is attached to a holster designed to be worn inside an article of clothing.

FIG. 15 depicts a side view (opposite from the side shown in FIG. 13) of an adjustable tension device with exemplary interchangeable extension arms, where one extension arm is installed, and where said adjustable tension device is attached to a holster designed to be worn inside an article of clothing.

FIG. 16 depicts a rear view of an adjustable tension device with exemplary interchangeable extension arms, where one extension arm is installed, and where said adjustable tension device is attached to a holster designed to be worn inside an article of clothing.

Figures 1, 2, 3, 4, 5:
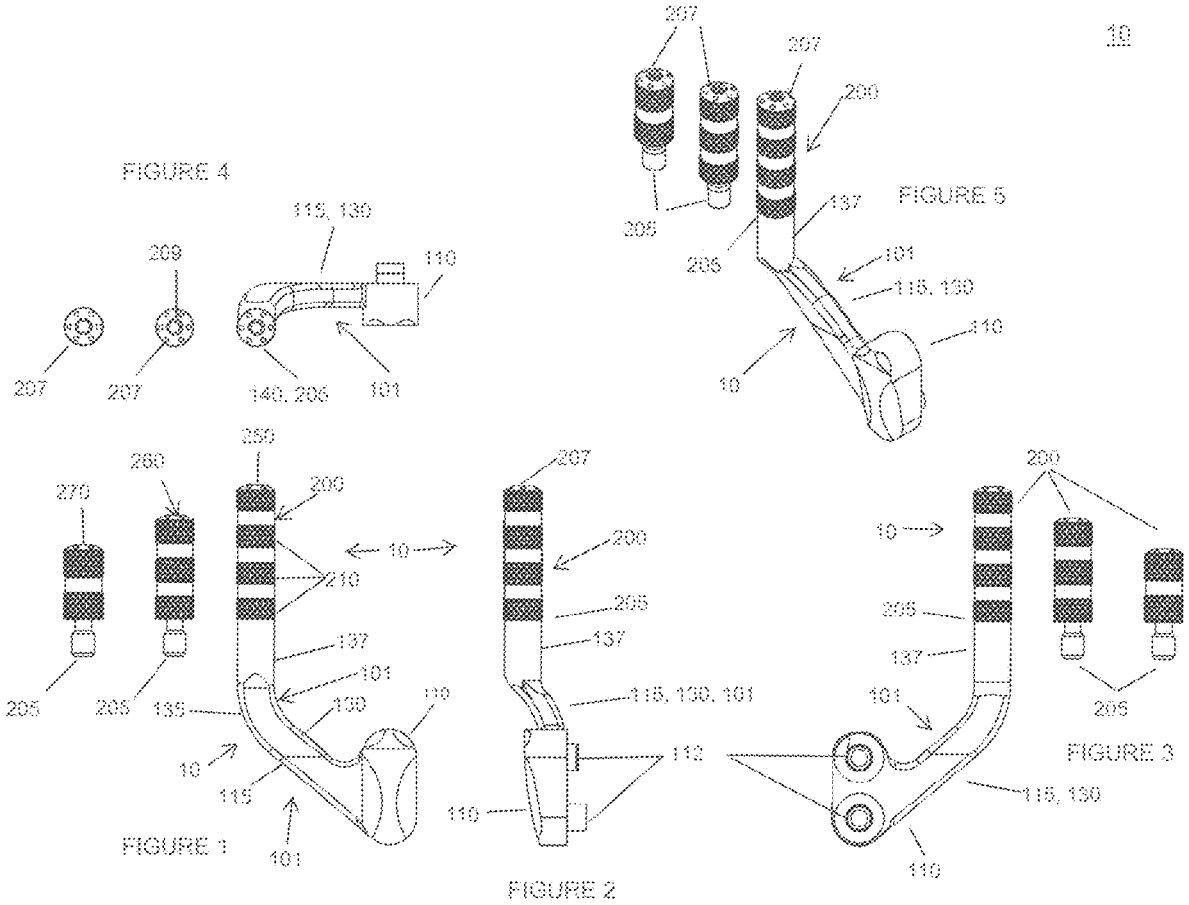
FIG. 1 depicts a prospective front view of an adjustable tension device with exemplary interchangeable extension arms, where one extension arm is installed.
FIG. 2 depicts a side view of another embodiment of an adjustable tension device with exemplary interchangeable extension arms, where one extension arm is installed.
FIG. 3 depicts a rear view of an adjustable tension device with exemplary interchangeable extension arms, where one extension arm is installed.
FIG. 4 depicts a top view of an adjustable tension device with exemplary interchangeable extension arms, where one extension arm is installed.
FIG. 5 depicts a front, perspective view of an adjustable tension device with exemplary interchangeable extension arms, where one extension arm is installed.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures, is not intended to limit the scope of the disclosure, as claimed, but is merely representative of possible embodiments of the disclosure.

The present invention comprises an adjustable tension device 10. As shown in FIG. 1, adjustable tension device 10 comprises fixed arm 101, which in turn comprises base 110 and lower arm 115. Base 110 further comprises fastening points 112 located on the rear of base 110 (see, e.g., FIGS. 2 and 3). Fastening points 112 are operable to allow device 10 to be fixed to an accessory such as a holster (see, e.g., FIG. 14). In one embodiment, fastening points 112 are threaded holes operable to receive screws; however, other known attachment means may be used, such as snaps, rivets, etc.

Lower arm 115 comprises first member 130 which extends away from base 110. In the embodiment shown in the attached Figures, first member 130 extends away from base 110 along all three-dimensional axes, namely, the horizontal and vertical planes in which base 110 is found, as well as the plane perpendicular to the plane of base 110. As shown, for example, in FIGS. 1-5, lower arm 115 extends outwardly from base 110 in a generally diagonal direction while gradually moving away from, and perpendicular to, the plane of base 110 (see, e.g., FIG. 2 and FIG. 3). More generally, lower arm 115 can take any shape so long as it provides enough spatial separation from base 110 to provide adequate leverage and/or tension between the attached extension arm 200 and the accessory to which device 10 is attached and the user's belt or other article of clothing.

In the disclosed embodiments of FIGS. 1-10, lower arm 115 further comprises bend 135. At bend 135, lower arm 115 turns along a plane that runs generally parallel to the vertical orientation of plane of base 110, and lower arm 115 no longer extends outward from base 110 in the plane perpendicular to the plane of base 110. Bend 115 orients the extension of the lower arm, the second arm upwardly. The orientation of the lower arm 115, the second arm 137 and the base 110 are best understood when the adjustable tension device 10 is mounted on a holster accessary, best seen in FIGS. 13, 14 and 16.

As shown in these figures, the tension device 10 is mounted on a holster accessory device 100. As shown, the holster 100 has an inside wall 100*a* and an outside wall 100*b*, defining a hollow therebetween to contain a handgun. The two walls are joined on a front barrel edge 100*c* and a rear trigger edge 100*d*, where a flat portion 300 is located interior to the rear trigger edge 100*d*. At the upper end or belt-end of the outside wall 100*a* is mounted a belt clip 205, (or belt retainer) which, when the holster is worn, a belt and/or clothing extends through the belt clip 205, to maintain the holster in place against the wearer's body, such as adjacent the wearer's waist. As shown in this embodiment of a holster, the adjustable tension device 100 is mounted on the outside wall 100*a* below the belt clip 205 on the flat portion 300 of the holster 100. The intent is to position the tension arm so that the attached extension arm 200 is separated from the belt clip 205, but preferably at the height of the belt clip 205 with the top of the extension arm 200 preferably at the top of the opening 205*a* in belt clip 205. See FIGS. 12, 13 and 14. The extension arm 200 can be located inward of the clip opening 205*a* (FIG. 13), aligned with the opening 205*a* of the belt clip, or outward of the opening 205*a*in the belt clip. When used, the belt clip 205 is attached to the user's belt or clothing, and the lower end of the holster will be inside the users clothing. The tension device 10 will also be inside the users clothing with the extension arm 200 preferably bearing on the clothing near the waistband and/or the belt. When the belt is tightened, the belt places a tension on the extension arm 200, thereby drawing the rear trigger edge of the holster into the user's body. The tension device's 10 extension arm 200 is designed to press against the wearers belt or clothing in order to drive the butt of the weapon into the users' body for maximum concealment. In the holster shown, the lower arm 115 must move outwardly and upwardly to properly position the extension arm 200 in the preferred position. Consequently, the lower arm's shape with respect to the base will depend on the holster design and location of the belt clip, and on the location of the tension device mount 110 on the holster.

Moving long lower arm 115 away from base 110, after bend 135, lower arm 115 further comprises second member 137, where second member 137 extends upwardly in a direction generally parallel to the vertical orientation of base 110 (and vertically with respect to the accessory). It should be generally recognized that second member 137 need not be parallel to the vertical orientation of base 110; rather, second member 137 need only extend generally in a direction that will allow extension arm 200 to come into contact with a user's belt or other article of clothing such that device 10 is able to provide tension between the user's clothing and the accessory attached to device 10 to draw the accessory into the users; body.

Second member 137 further comprises attachment port 140, (see FIGS. 6 & 7) located at the end of lower arm 115 opposite the end of lower arm 115 connected to base 110. In one embodiment, attachment port 140 is a female threaded hole operable to receive a male threaded screw or bolt or another male threaded fastener. In alternative embodiments, attachment port 140 can comprise any female connection point, such as a snap-in receptacle, a quick connect, an orientated locking receptacle, or other means of receiving and fixedly holding extension arm 200. Alternatively, the attachment port 140 may comprise a male locking member, to receive an intermating female connecting member located on the end of the extension arm 200, to allow the extension arm 200 to fixedly connect to the extension arm 137.

Device 10 further comprises extension arm 200. As shown in the various Figures, one embodiment of extension arm 200 is a cylindrical member comprising an attachment point 205 on one end and notched endcap 207 on the opposite end. Extension arm 200 further comprises one or more circumferential grip areas 210 operable to add friction between extension arm 200 and the user's belt or clothing. In an exemplary embodiment, grip areas 210 are cross-hatched grooves carved into the surface of member 200; in other embodiments, grip areas 210 are rough or frictional surfaces layered on top of, or otherwise attached to, the outer surface of each extension arm 200 via an adhesive or other bonding technique. It should be generally recognized that grip areas 200 may comprise any rough surface. It should be further appreciated that extension arm 200 may be any shape so long as grip areas 210 face outward from the user's body when extension arm 200 is fixed to lower arm 115. The extension arms 200 shown in the Figures is cylinders. For a screw or bolt connection, a cylinder is a preferred shape. But other shapes of the extension arm are possible if the connection between the extension arm 200 and the second arm 137 is an orientated connection, where the parts have only one orientation hat couples. For instance, the crossed hatch paddle shown in D919,964 (incorporated by reference) can be used as the gripping part or frictional area of the extension arm.

In an exemplary embodiment, attachment point 205 is a male threaded portion operable to be fixedly received by a female threaded port. In alternative embodiments, attachment point 205 can comprise any male connection point, such as a snap-in extension, a locking extension, a quick connection, or other means of fixedly connecting to lower arm 115 at attachment port 140.

As shown in the various Figures, extension arm 200 comes in a variety of lengths. For example, long length 250, medium length 260, and short length 270 as shown in FIGS. 1-5. In an exemplary embodiment, additional grip areas 210 are added as the length of member 200 is increased.

In an exemplary embodiment, notched endcap 207 comprises one or more indentations 209 which allow the user to interface a screwdriver or other equivalent tool with endcap 207, thereby allowing the user to rotate member 200 in a manner that aids in securing member 200 to lower arm 115. Indentations 209 may be configured to accept any manner of tool, such as flat-head, Philips, hex-headed (i.e., such as an Allen wrench), or star-headed (torx) screwdrivers. In an alternative embodiment, indentations 209 may come in a variety of patterns, including those depicted in U.S. Design Pat. No. D869,945, which is incorporated herein by reference.

In an alternative embodiment, attachment port 140 can be a male connection point, and attachment point 205 can be a corresponding female connection point.

FIGS. 11-16 show various views of device 10 mounted on an exemplary accessory, here a firearm holster intended to be worn in a concealed location inside of the user's waistband. In this exemplary configuration, device 10 is aligned with holster 1300 such that extension arm 200 would be positioned so that it pushes against the interior of the user's waistband in the same area of the user's where the user's belt would be located on the exterior of the user's waistband.

In practice, the user would select the proper length of extension arm 200 based on the orientation of the accessory. For example, if the user wears a holster such as holster 20 in combination with an adjustable belt retainer 2 as shown in U.S. Pat. App. Pub. No US 2015/0097011, which is incorporated herein by this reference, then the user will be able to adjust the alignment of the holster at an angle to the associated belt retainer/clip. Where the holster is oriented such that the device 10 is closer to the user's belt line, a short extension arm (such as short length 270) might be more appropriate. By contrast, where the holster is oriented such that the device 10 is farther from the user's belt line, a longer extension arm (such as long length 250) might be more appropriate.

What is claimed is:

1. An adjustable tension device for use with a holster comprising:

a base, a fixed arm having a first member and a second member, the first member and the second member separated by a bend portion, and an extension arm, wherein the first member of the fixed arm extends in a diagonal direction away from the base up to the bend portion, wherein the second member extends in a direction that is offset from the orientation of the first member, wherein the second member of the fixed arm is removably coupled to the extension arm.

2. The adjustable tension device of claim 1, wherein the base is operable to attach to an accessory, wherein the accessory is operable to be worn at least partially inside of a user's clothing.

3. The adjustable tension device of claim 2, wherein the base has at least one base attachment point for attaching to an accessory.

4. The adjustable tension device of claim 1, wherein the extension arm comprises a cylindrical shape.

5. The adjustable tension device of claim 1, wherein the extension arm has an outer surface and at least one grip area positioned on the outer surface.

6. The extension arm of claim 5, wherein the extension arm comprises a cylindrical shape arm having an outer surface and at least one grip area positioned on the outer surface of the extension arm, and the grip area comprises at least one circumferential grip area on the outer surface, wherein the circumferential grip area comprises a frictional surface.

7. The adjustable tension device of claim 1, wherein a first end of the extension arm comprises a male attachment member or a female attachment member capable of removably coupling with a corresponding female attachment member or a male attachment member on the fixed arm.

8. The adjustable tension device of claim 1 comprising a series of extension arms, wherein each extension arm of the series is separately removably couplable to the second member of the fixed arm, where each extension arm in the series differs in length or thickness from the remaining extension arms in the series.

9. A kit comprising a holster and an adjustable tension device, the adjustable tension device comprising a series of extension arms, a fixed arm, and a base attached to the holster, wherein the fixed arm is attached to the base, and an end of the fixed arm distal to the base comprises a first attachment point, wherein each of the extension arms in the series of extension arms are operable to separately removably couple with the attachment point of the fixed arm, and wherein each of the extension arms in the series of extension arms is different in length or thickness from the remaining extension arms in the series of extension arms.

10. The kit of claim 9, wherein each of the extension arms in the series has a least one grip surface positioned on an outer surface of each extension arm in the series, and when the holster is worn by a user, at least one of the extension arm's grip surface, when the extension arm is removably coupled to the attachment point, is positioned facing an interior surface of a belt or is facing an interior surface of clothing on the waistband area of the user.

11. The kit of claim 9, wherein each of the extension arms in the series of extension arms has a first end that has a second attachment point operable to removably couple with the first attachment point.

12. The kit of claim 11, wherein the holster has a belt clip or belt retainer.

* * * * *